United States Patent [19]

Vidler

[11] 4,228,720

[45] Oct. 21, 1980

[54] HARMONICA PLAYING MEANS

[76] Inventor: James W. Vidler, 38 High St., Waratah, N.S.W., 2298, Australia

[21] Appl. No.: 32,959

[22] Filed: Apr. 24, 1979

[51] Int. Cl.[3] ..... G10D 7/12

[52] U.S. Cl. ..... 84/377

[58] Field of Search ..... 84/377–379

[56] References Cited

U.S. PATENT DOCUMENTS

| | | | |
|---|---|---|---|
| 375,608 | 12/1887 | Delano | 84/377 |
| 904,914 | 11/1908 | Anderson | 84/377 |
| 1,285,747 | 11/1918 | Laukandt | 84/377 |
| 1,806,689 | 5/1931 | Jontof | 84/377 |
| 2,137,251 | 11/1938 | Steele | 84/377 |
| 2,192,983 | 3/1940 | Moore | 84/377 |
| 2,496,511 | 2/1950 | Abbott | 84/377 |
| 3,273,440 | 9/1966 | Tsui | 84/377 |
| 3,580,125 | 5/1971 | Heatwole | 84/377 |
| 3,589,232 | 6/1971 | Peters | 84/377 |
| 3,619,471 | 11/1971 | Tsui | 84/377 |

FOREIGN PATENT DOCUMENTS

| | | | |
|---|---|---|---|
| 927186 | 10/1947 | France | 84/377 |

*Primary Examiner*—Lawrence R. Franklin

*Attorney, Agent, or Firm*—Stevenes, Davis, Miller & Mosher

[57] ABSTRACT

A device to facilitate playing a mouth blown harmonica comprising a body with a plurality of flaired air channels which extend from registry with the harmonica blow holes to the outer periphery of the body. That periphery is shaped to fit the mouth of the user so that a single channel can be easily used at any one time.

4 Claims, 11 Drawing Figures

HARMONICA PLAYING MEANS

This invention relates to harmonicas or mouth organs, and more particularly to an improved means for playing such an instrument.

At present, the conventional technique for playing a harmonica involves an inherently contrived action, dictated by the diminuitive size of the instrument in relation to human anatomy. Thus, it is customary for a player's lips to be placed over four holes of the exposed multi-hole mouth-piece whilst three of said holes are covered by the flat of the player's tongue, thereby permitting a blowing action to sound a note corresponding to the fourth hole only.

It is thus an object of the present invention to provide means whereby a player's entire mouth may be employed in a more natural manner to blow a single selected note corresponding to a particular hole of said mouth-piece. Various attempts have been made to overcome the disadvantage resulting from the disparity betwen the size of this instrument and that of a player's mouth. For example, in the system described in U.S. Pat. No. 2,137,251 a so-called "chord coupler" is slidable in the form of an auxiliary mouth-piece having a number of holes, each of which may be selectively registered with a plurality of differently tuned reeds of a harmonica as required. However, this expedient has itself suffered from the disadvantage that the instrument is thereby rendered difficult to play.

It is therefore a further object of the present invention to provide a system wherein a harmonica may be held in the player's hands in a normal fashion, and wherein the integrity of the instrument is maintained in that it is possible for a player to select and produce notes individually using the entire mouth for blowing purposes.

Accordingly, the invention in one of its aspects comprises, in a mouth-blown harmonica, the improvement wherein the wind-entrance apertures thereof are in communication with a trumpet, said trumpet having therein a plurality of discrete flaired channels, each wider at the respective inlet end thereof than at the respective outlet end thereof, each outlet end of said plurality of channels terminating in registration with a single wind-entrance aperture of said harmonica, and each respective inlet end of said channels terminating in an embouchure aperture of mouth-conforming size, all said embouchure apertures lying in longitudinal juxtaposition along the outer periphery of said trumpet, allowing each separate note of said harmonica to be sounded by the entire mouth of a player applied selectively to an appropriate one of said embouchure apertures which is in communication, via its associated channel, with the wind-entrance aperture corresponding to said note.

Figure 1:
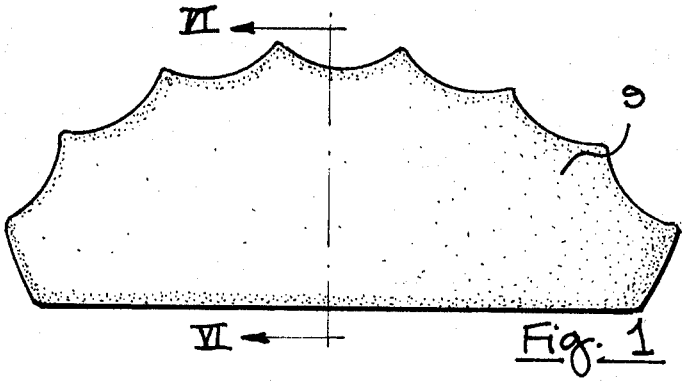
Figure 2:
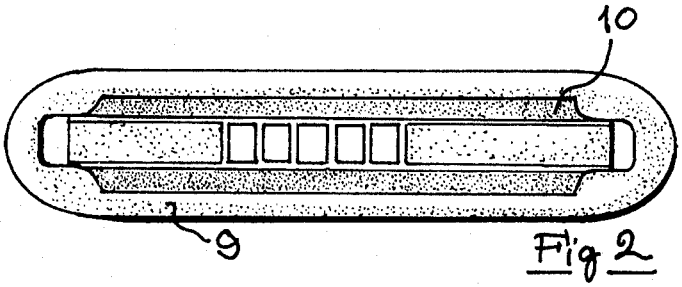
Figure 3:
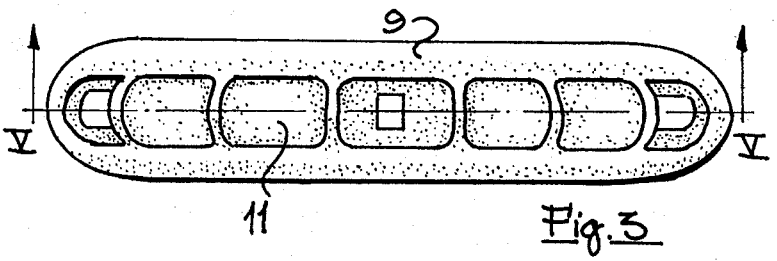
Figure 5:
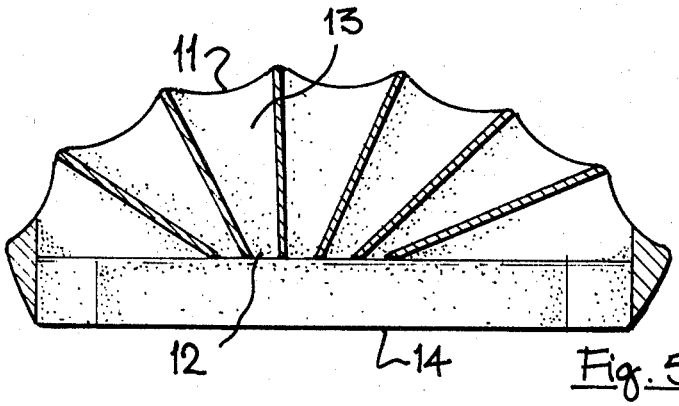
Figure 7:
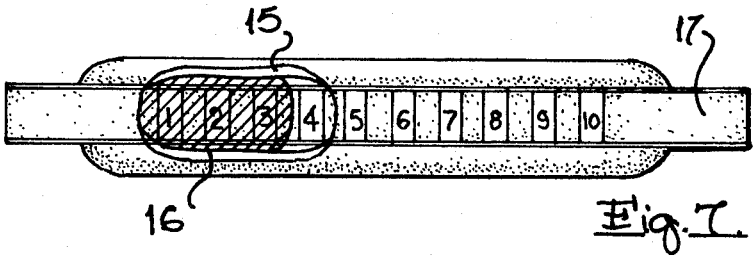
Figure 8:
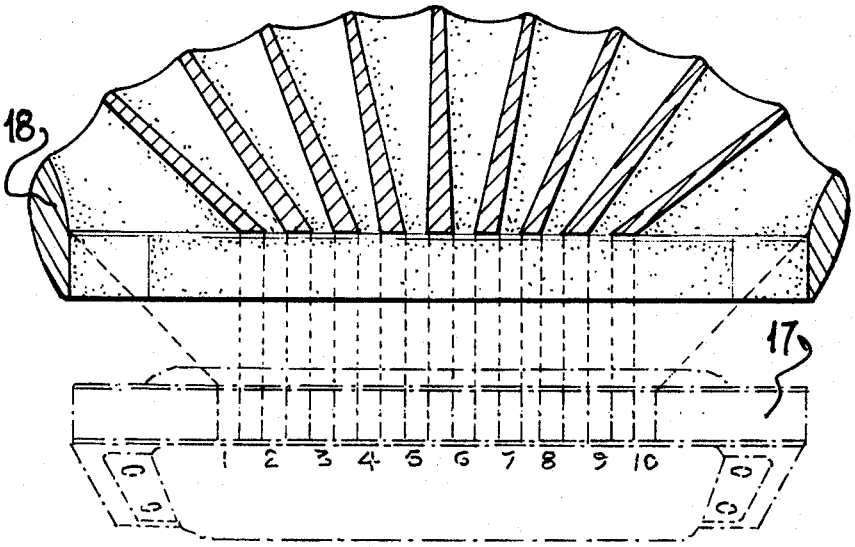
Figure 4:
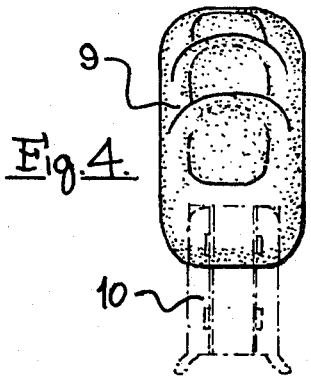
Figure 6:
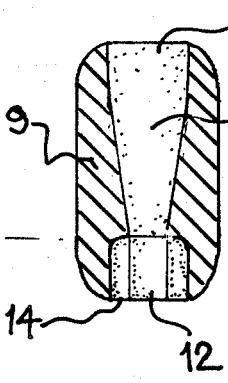
Figure 9:
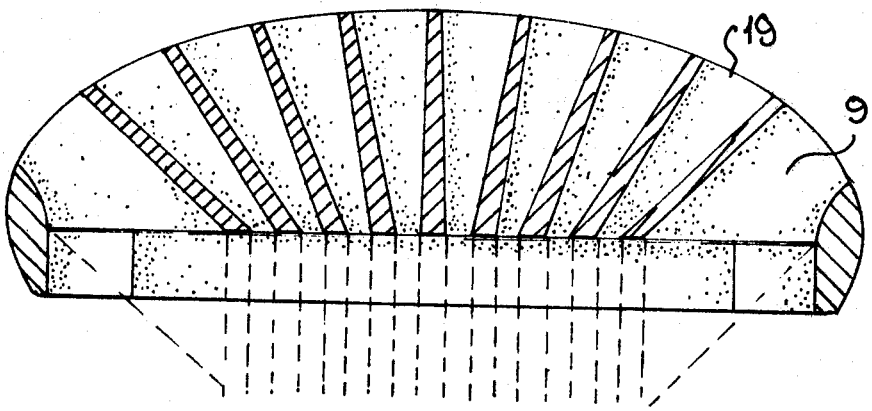
Figure 10:
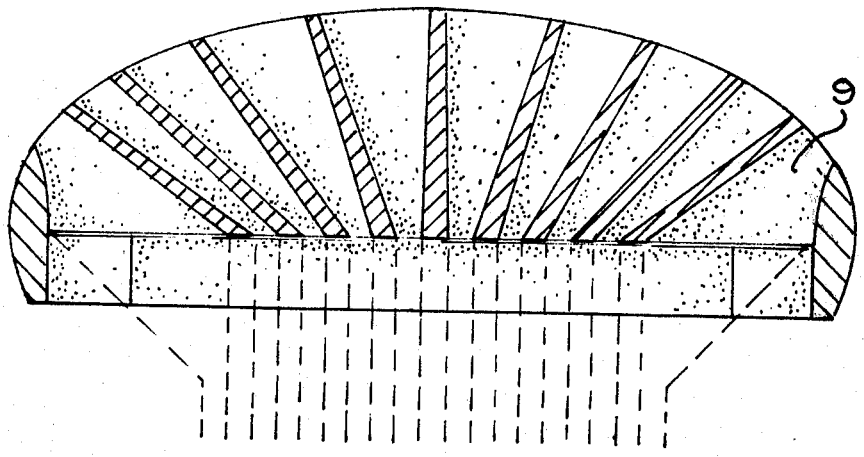
Figure 11:
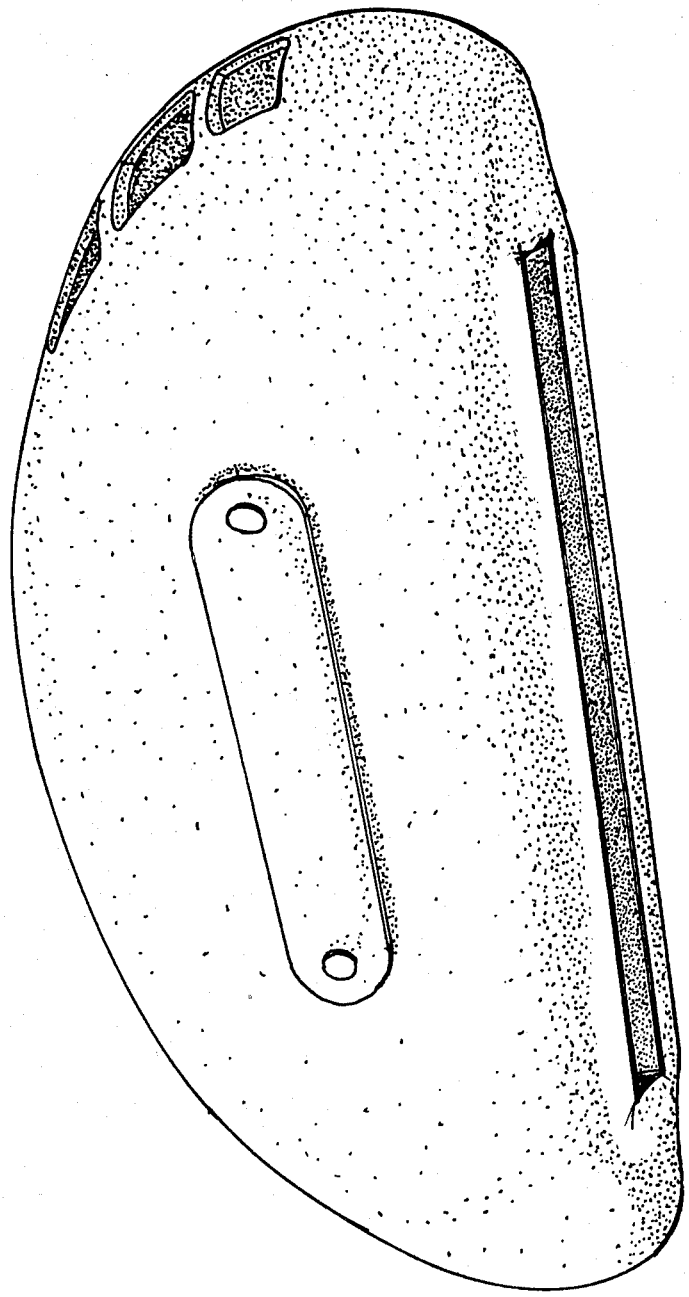

Certain embodiments of the invention defined in the preceding paragraph will now be described herein with reference to the accompanying drawings, in which similar references indicate corresponding parts, and in which:

FIG. 1 shows, in side elevation, a trumpet adapted to fit a typical seven-hole harmonica, FIG. 2 shows, in plan view from below, the apparatus of FIG. 1, FIG. 3 shows, in plan view from above, the apparatus of FIG. 1, FIG. 4 shows, in end elevation, the apparatus of FIG. 1, FIG. 5 shows a section along the line 5—5 of FIG. 3, FIG. 6 shows a section along the line 6—6 of FIG. 1, FIG. 7 shows, schematically, how the tongue blocks three of four holes of a typical ten-hole harmonica, FIG. 8 is an imaginary longitudinal section through a typical ten-hole harmonica with a chain-lined representation of the correlation between the exit apertures of the trumpet and the holes of the harmonica instrument, FIG. 9 shows, in side elevation, a sectional view of a modification of said trumpet in which the periphery is smooth, FIG. 10 shows, in side elevation, a sectional view of a modification of the apparatus of FIG. 9 in which the angular width of its channels is varied, and FIG. 11 shows, in perspective view, a further modification of the invention wherein said trumpet is integral with a harmonica.

Upon referring to FIGS. 1 to 6 of the drawings it will be seen that a rigid trumpet 9 is adapted to engage with a press-fit the body 10 of a harmonica, in this case one fitted with seven holes in its mouthpiece. The embouchure apertures such as 11 communicate with exit apertures such as 12 via respective discrete channels such as 13, the latter being tapered as shown from the outer periphery, which is shaped generally in the form of an arc, towards the inner flat portion 14 thereof which is adapted to engage the corresponding flat outer surface of the mouth-piece of the harmonica instrument.

It will be appreciated that it is merely necessary to adjust the scale of the trumpet, having due regard to the fact that the size of the holes in the mouthpiece is predetermined, so that the channels 13 are of such length that they may flare outwardly towards said periphery to an extent which ensures that the embouchure apertures 11 are each commensurate in size with the mouth of a player, to enable the latter to apply his mouth fully to cover each said embouchure aperture which he may wish to engage to blow the note corresponding to the hole or wind-entrance aperture of the harmonica mouth-piece which lies in registration with the corresponding exit aperture 12.

This is contrary to the prior art illustrated schematically in FIG. 7, wherein the mouth of a player is applied to the region 15 so as to cover, say, the first four holes of a ten-hole harmonica 17 whilst the flat of his tongue would be located firmly in the region indicated at 16 so as to block the first three holes, thereby causing the blowing of the note represented by hole 4 only, when said harmonica is held in the conventional manner by his hands so as to locate the bass notes to the left.

FIG. 8 shows how the same harmonica 17, when provided with a ten-channel trumpet 18 in accordance with a modification of the invention, has the exit apertures of the trumpet correlated with the ten holes of the harmonica mouth-piece as above described.

The trumpet may be constructed as a unitary device or otherwise from any suitable rigid material, such as plastic, wood or metal, provided that the arcuate periphery has a sufficiently smooth surface for comfortable rubbing contact with the player's lips, and provided that the flat portion is suitably dimensioned to ensure the necessary push-fit to enable it to engage the body of the instrument or be removed therefrom as desired.

The channels 13 are so constructed, and the fit between the trumpet 9 and the harmonica body 10 is of sufficient precision, to ensure that little or no leakage or air takes place during the flow thereof from a selected embouchure aperture towards a hole to which it is directed.

It will be seen that the invention provides a system which gives a harmonica player an enhanced degree of control over the instrument, having regard to its dimensional shortcomings, without the need for any sliding or other mechanical adjustment of the parts thereof during actual play.

In a further modification of the invention, shown in FIG. 9, an even greater degree of smoothness may be given to the arcuate periphery 19 than in the arrangement best shown in FIGS. 1, 5 and 8, to aid the free lateral sliding of the player's lips.

In a still further modification of the invention, shown in FIG. 10, provision is made for the variable frequency of use of the notes of a harmonica for any one melody. Thus in one statistical analysis of such frequencies it has been found that in a ten-hole harmonica the most used notes were the fourth, fifth and sixth (counting, as is customary, from the bass) so that in descending order of frequency the usage was as follows:

Most common: 4th, 5th, 6th.

Next: 7th, 8th.

Next: 3rd.

Next: 9th.

Next: 1st, 2nd, 10th.

Accordingly, as a reasonable compromise, the widths of the corresponding channels in the trumpet 9 of FIG. 10 are shown typically with the 4th, 5th and 6th channels having a greater, but equal, value whereas the remaining channels each have a lesser, but equal, width. As a result, the player would require a reduced total number of lateral movements of the lips when playing most melodies.

In yet another modification of the invention, shown generally in FIG. 11, the trumpet above described may be incorporated as a unitary structure by forming it integrally with a harmonica instrument of new manufacture in a manner which will be clear to those skilled in the art.

I claim:

1. In a mouth-blown harmonica, the improvement wherein the wind-entrance apertures thereof are in communication with a trumpet, said trumpet having therein a plurality of discrete flaired channels, each wider at the respective inlet end thereof than at the respective outlet end thereof, each outlet end of said plurality of channels terminating in registration with a single wind-entrance aperture of said harmonica, and each respective inlet end of said channels terminating in an embouchure aperture of mouth-conforming size, all said embouchure apertures lying in longitudinal juxtaposition along the outer periphery of said trumpet, allowing each separate note of said harmonica to be sounded by the entire mouth of a player applied selectively to an appropriate one of said embouchure apertures which is in communication, via its associates channel, with the wind-entrance aperture corresponding to said note.

2. The improvement as claimed in claim 1, wherein said trumpet is a discrete, unitary structure adapted for removable and at least partially air-tight press-fit attachment to an existing mouth-blown harmonica.

3. The improvement as claimed in claim 2, wherein said discrete, unitary trumpet structure is made from a rigid plastics material.

4. The improvement as claimed in claim 1, wherein said trumpet is integrally formed with the housing of said mouth-blown harmonica.

* * * * *